US007724274B2

(12) United States Patent
Sasaki

(10) Patent No.: US 7,724,274 B2
(45) Date of Patent: May 25, 2010

(54) THERMAL PRINTER

(75) Inventor: Tsuneyuki Sasaki, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 121 days.

(21) Appl. No.: 12/054,140

(22) Filed: Mar. 24, 2008

(65) Prior Publication Data

US 2008/0239059 A1 Oct. 2, 2008

(30) Foreign Application Priority Data

Mar. 29, 2007 (JP) ..... 2007-088086

(51) Int. Cl.
*B41J 29/377* (2006.01)

(52) U.S. Cl. ..... 347/223

(58) Field of Classification Search ..... 347/223
See application file for complete search history.

(56) References Cited

U.S. PATENT DOCUMENTS 4,972,205 A 11/1990 Nagato
5,272,491 A * 12/1993 Asakawa et al. ..... 347/18
5,357,271 A 10/1994 Wiklof et al.
6,822,665 B2 * 11/2004 Sugiyama et al. ..... 347/200
2005/0237370 A1 * 10/2005 Elgee et al. ..... 347/102

FOREIGN PATENT DOCUMENTS

DE 39 40 545 A1 6/1990
EP 0 484 034 A1 5/1992
EP 1 151 869 A1 11/2001
JP 2004-142357 5/2004

OTHER PUBLICATIONS

Search Report issued in corresponding European Patent Application No. 08 00 3908; issued Jul. 9, 2009.

* cited by examiner

*Primary Examiner*—Huan H Tran
(74) *Attorney, Agent, or Firm*—Brinks Hofer Gilson & Lione

(57) ABSTRACT

A thermal printer includes a heat sink in which a latent-heat-type heat storage sheet in which a plurality of heat storage materials are added to a base material is attached to a thermal conduction plate. The thermal conduction plate provided in contact with the thermal head. Each of the heat storage materials starts to melt if absorbed heat reaches a predetermined temperature, and the heat storage sheet stores heat while being maintained at a fixed temperature, while each of the heat storage materials melts. A radiation portion that is subjected to surface processing for improving the radiation rate of the heat storage sheet is provided on the surface of the heat storage sheet.

1 Claim, 3 Drawing Sheets

THERMAL PRINTER

This application claims benefit of Japanese Patent Application No. 2007-088086 filed on Mar. 29, 2007, which is hereby incorporated in its entirety by reference.

BACKGROUND

1. Field of the Invention

The present invention relates to a thermal printer including a heat sink that removes the heat of a thermal head.

2. Description of the Related Art

Conventionally, a thermal printer that makes a plurality of heat-generating elements, which are provided in a thermal head, generate heat selectively on the basis of recording data, thereby recording an image, such as a desired character or a figure, on a recording medium, is often used as an output unit of a computer or the like.

FIG. 3 is a schematic sectional view showing an example of the conventional thermal printer. As shown in FIG. 3, a plurality of heat-generating elements 23 are arranged in parallel in a thermal head 22 in a conventional thermal printer 21. Also, such a thermal printer 21 makes each heat-generating element 23 generate heat selectively on the basis of input recording data, thereby making the ink of an ink ribbon (not shown) melt or sublimate and transfer to a recording medium so as to record a desired image.

If excessive heat is applied to each heat-generating element 23 in such a thermal printer 21, there is a possibility that ink may be melted or sublimated excessively. As a result, poor transfer of ink may occur, so that it is impossible to record a good image.

Thus, in the conventional thermal printer 21, in order to prevent heat from being excessively applied to each heat-generating element 23, a cooling structure is used that removes the heat applied to each heat-generating element 23 using a heat sink 25.

The heat sink 25 in this cooling structure has a thermal conduction plate 26, and one end of the thermal conduction plate 26 is attached to one face of the thermal head 22. Further, in this cooling structure, a cooling fan 27 that can circulate the air inside and outside a housing 28 of the thermal printer 21 is disposed in the vicinity of the heat sink 25.

Also, in the thermal printer 21 including such a cooling structure, the heat stored in the thermal head 22 is removed by being conducted to the thermal conduction plate 26. Further, in the thermal printer 21, heat is emitted by sending air by means of the cooling fan 27 to thereby emit the heat conducted to the thermal conduct ion plate 26, and heat is radiated by circulating the air inside the housing 28 of the thermal printer 21 heated by the heat emitted from the thermal conduction plate 26, and discharging the air to the outside of the housing 28. Accordingly, the cooling structure of the thermal printer 21 cools the thermal head 22.

The above-mentioned conventional thermal printer is disclosed in JP-A-2004-142357.

In recent years, the demand for reduction in size and thickness of the thin thermal printer 21 has increased. However, in the cooling structure of the thermal printers 21 as mentioned above, the cooling fan 27 is used to emit the heat of the thermal conduction plate 26 and emit the heat inside the thermal printer 21 to the outside of the thermal printer 21, and an installation region for the cooling fan 27 is needed. Therefore, there is a problem in that it is difficult to make the thermal printer 21 small and thin. Further, according to the thermal printer 21 that cools the heat sink 25 using the cooling fan 27, in order to make the heat of the thermal conduction plate 26 efficiently emitted into the air by air blowing by the cooling fan 27, it is necessary to circulate air inside the housing 28. For this reason, a space for efficiently circulating air inside the housing 28 is needed. Accordingly, it is difficult to make the thermal printer 21 smaller and thinner. Moreover, in the conventional thermal printer 21, the thermal head 22 may be heated to a temperature more than a predetermined temperature by performing recording operation continuously. In such a case, there is a possibility that poor transfer of ink may occur as mentioned above, and recording of a good image cannot be obtained. Therefore, there is also a problem in that cooling of thermal head 22 should be awaited, and the working efficiency of recording may be lowered.

On the other hand, a cooling structure of the thermal printer 21 that removes the heat of the thermal head 22 without using the cooling fan 27 in order to make the thermal printer 21 thin and small has also beens considered. However, in the conventional cooling structure in which the cooling fan 27 is not used, it is necessary to make the heat sink 25 large so that cooling performance may not be lowered. For this reason, there is a problem that it is eventually difficult to make the thermal printer 21 thin and small.

SUMMARY

A thermal printer includes a thermal head provided with a heat-generating element, and a head supporting portion that supports the thermal head. A sheet-like heat storage member is attached to the other end of the head supporting portion opposite its one end where the thermal head is supported, and the thermal head is directly secured to the head supporting portion.

According to the thermal printer according to the invention, since the heat of the thermal head is stored in the sheet-like heat storage member via the thermal conduction plate without heating the air inside the thermal.

As described above, according to the thermal printer according to the invention, the thermal head can be efficiently cooled without providing a cooling fan. Thus, the thermal printer can be made small and thin without lower the cooling performance of the heat sink.

DESCRIPTION OF THE EMBODIMENTS

Hereinafter, one embodiment of a thermal printer using a heat sink will be described with reference to FIGS. 1 and 2.

Figure 1:
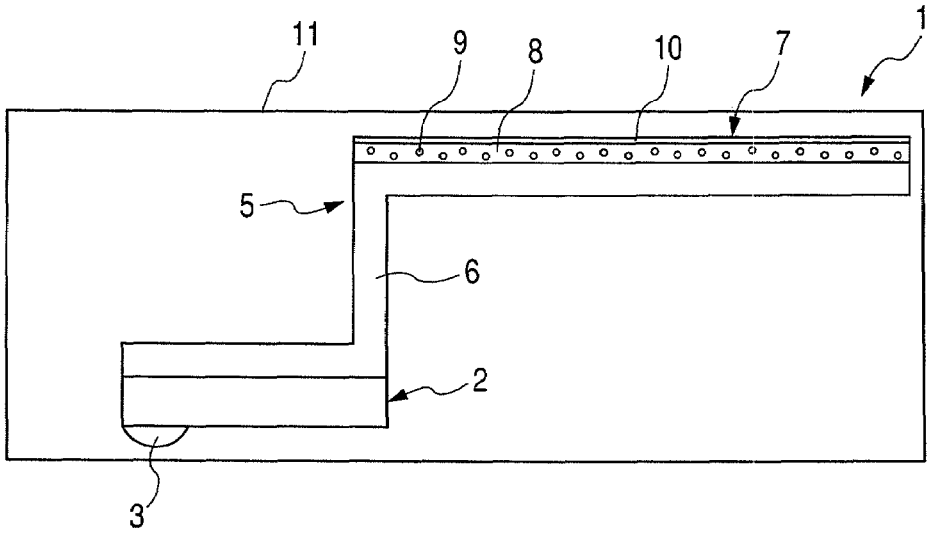
FIG. 1 is a schematic sectional view showing one embodiment of a thermal printer using a heat sink.
Figure 2:
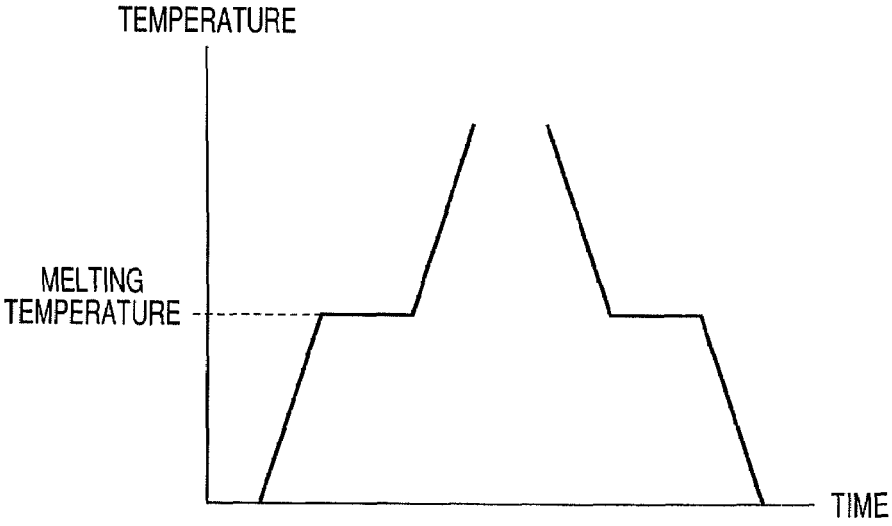
FIG. 2 is a graph showing the relationship between heat storage temperature and time of a latent-heat-type heat storage sheet used for the heat sink of FIG. 1.
Figure 3:
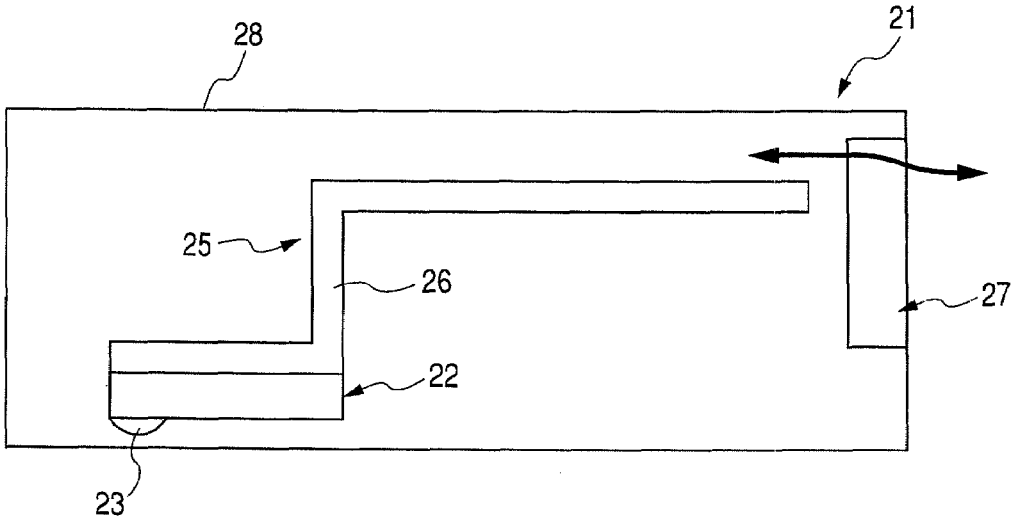
FIG. 3 PRIOR ART
FIG. 3 is a schematic sectional view showing an example of a thermal printer using a conventional heat sink.

FIG. 1 is a schematic sectional view showing the thermal printer according to this embodiment. As shown in FIG. 1, the thermal printer 1 includes a thermal head 2, and a plurality of heat-generating elements 3 are arranged in parallel on the face of the thermal head 2 that faces a recording medium with an ink ribbon (not shown) therebetween. Also, the thermal head 2 makes a desired heat-generating element 3 generate heat on the basis of recording data input to the thermal printer 1, thereby making the ink of the ink ribbon melted or sublimated and transferred to the recording medium so as to record a desired image on the recording medium.

Further, the thermal printer 1 includes a heat sink 5 for cooling the thermal head 2 heated by making each heat-generating element 3 generate heat. The heat sink 5 has a thermal conduction plate 6, which is made of an aluminum material, etc. with good thermal conductivity, as a head supporting portion that supports the thermal head 2, and one end of the thermal conduction plate 6 is attached to the face of the thermal head 2 opposite the face thereof where each heat-generating element 3 is formed.

A sheet-like heat storage member for storing the heat conducted to the thermal conduction plate 6 is adhered to the other end of the thermal conduction plate 6. As this heat storage member, for example, a latent-heat-type heat storage sheet 7 in which a plurality of granular heat storage materials 9 that composed of a polymeric material that, etc. melts at a predetermined temperature and is solidified at a predetermined temperature are added to a base material 8 composed of an acrylic material, etc. The latent-heat-type heat storage sheet 7 is adapted to store heat using the melting point of each heat storage material 9 as each heat storage material 9 absorbs the heat conducted to the thermal conduction plate 6 and melts. Each heat storage material 9 start melting if the absorbed heat reaches a predetermined melting temperature, and is maintained at a fixed temperature while each heat storage material 9 melts as shown in FIG. 2. If all the heat storage materials 9 melt, the temperature of the heat storage sheet 7 rises. As for the heat storage sheet 7, the melting temperature can be set to a predetermined temperature within a range of, for example, 20 to 70° C. by adjusting a polymeric material. Here, if the thermal head 2 is heated excessively, there is a possibility that recording quality may deteriorate. Thus, in the thermal printer 1 in which driving of the thermal head 2 is interrupted when the thermal head reaches a predetermined temperature, the melting temperatures of the heat storage material 9 are set to temperatures lower than a standby temperature at which the driving of the thermal head 2 is interrupted.

Further, it is preferable that the thickness of the latent-heat-type heat storage sheet 7 to be targeted in the invention be about 1 mm or more and about 5 mm or less. The heat storage sheet 7 can store the heat of sufficient temperature even if its thickness is about 5 mm or less. By using the heat storage sheet 7 whose thickness is about 5 mm or less, the thermal printer 1 can be made thin and small.

The face of the heat storage sheet 7 opposite the face thereof that is adhered to the thermal conduction plate 6 is formed as a radiation portion 10 that is subjected to surface processing for improving the radiation rate of the heat storage sheet 7. As the surface processing, for example, processing means, such as black lacquer painting, is used, and it is preferable that the radiation rate of the surface of the radiation portion 10 be set to about 0.8 or more. Accordingly, simultaneously when the heat storage sheet 7 stores heat, it radiates and transfers the stored heat to the housing 11 of the thermal printer 1 from the radiation portion 10, and emits the heat to the outside of the thermal printer 1 from the housing 11.

Next, the operation of this embodiment will be described.

The thermal printer 1 according to this embodiment makes each desired heat-generating element 3 generate heat on the basis of input recording data in recording a desired image on a recording medium. At this time, the heat applied to the thermal head 2 by the generation of heat of each heat-generating element 3 is conducted to the thermal conduction plate 6 of the heat sink 5 that is contacted with and attached to the thermal head 2, and the heat conducted to the thermal conduction plate 6 is stored in the heat storage sheet 7 as it melts each heat storage material 9 of the heat storage sheet 7. The heat stored in the heat storage sheet 7 is radiated to the housing 11 of the thermal printer 1 from the radiation portion 10 of the heat storage sheet 7 simultaneously when it melts each heat storage material 9, and is emitted to the outside of the thermal printer 1 from the housing 11 without heating an air layer inside the housing 11.

According to this embodiment, since the heat applied to the thermal head 2 by the generation of heat of each heat-generating element 3 is stored in the heat storage sheet 7 via the thermal conduction plate 6 without heating the air inside the housing 11, the thermal head 2 can be efficiently cooled without providing a cooling fan.

Accordingly, the thermal printer 1 including the thermal head 2 can be made small and thin without lowering cooling performance.

Moreover, by using a heat storage sheet 7 having a thickness of about 1 to about 2 mm or less and preferably about 5 mm or less as the heat storage sheet 7, the heat storage sheet 7 can store the heat conducted to the thermal conduction plate 6, and the thermal printer 1 can be made more small and thin.

Further, by using the latent-heat-type heat storage sheet 7 as a heat storage member, the heat storage sheet 7 is adapted to store heat using the melting point of each heat storage material 9, and is maintained at a fixed temperature while each heat storage material 9 melts. Thus, by storing the heat of the thermal head 2 via the thermal conduction plate 6, the temperature of the thermal head 2 can be maintained at a fixed temperature that is not heated excessively.

Furthermore, as for the heat sink 5, by forming the radiation portion 10 on the surface of the heat storage sheet 7, heat can be stored in the heat storage sheet 7, and simultaneously, the stored heat can be radiated by the radiation portion 10. Accordingly, the heat applied to the thermal head 2 can be efficiently emitted to the outside of the housing 11 without heating the air inside the housing 11 of the printer. Further, since heat is radiated and transferred by the radiation portion 10 and thereby emitted to the outside of the housing 11, it is not necessary to circulate air inside the housing 11, and it is therefore not necessary to provide a space for allowing air to be circulated into the housing 11. Accordingly, the thermal printer 1 can be made more small and thin.

Further, as for the heat sink 5, stored heat is radiated by the radiation portion 10 and is released from the inside of the housing 11 while the latent-heat-type heat storage sheet 7 is maintained at a fixed temperature. Thus, the heat applied to the thermal head 2 can be efficiently emitted to the outside of the housing 11, without heating the air inside the housing 11 of the thermal printer 1. Accordingly, the thermal head 2 can be efficiently cooled without providing a cooling fan, and the thermal printer 1 can be made small and thin.

Here, in the thermal printer 1 that performs recording using a plurality of kinds of ink, the thermal printer 1 that reciprocates a recording sheet to perform recording intermittently in order to locate a recording sheet in a recording start position for every recording of each ink is known.

In such a thermal printer 1, in the case of the continuous operation that recording is continuously performed from the start of recording using the thermal head 2 in a non-heated state from the viewpoint that recording is efficiently performed, about five sheets, the setting that driving of the thermal head 2 is not interrupted until recording of about five sheets from the start of recording is often made. For this reason, particularly, in the thermal printer 1 in which the standby time for which driving of the thermal head 2 is interrupted is set, by using the heat storage sheet 7, the time taken until the temperature of the thermal head 2 reaches a standby temperature can be delayed, and the heat storage sheet 7 can be suitably used for cooling of the thermal head 2.

Furthermore, by using the heat storage sheet 7, which is formed with the radiation portion 10, as a cooling means of the thermal head 2, the time taken until the heat storage sheet 7 reaches a melting temperature can be delayed. Further, since the heat of the heat storage sheet 7 is radiated by the radiation portion 10 even while the heat storage materials 9 melts, a radiating effect is exhibited gradually with time. Here, while the heat storage materials 9 melt, the heat storage sheet 7 has a high temperature at its surface, and thus has a large temperature difference from the housing 11. Consequently, as the temperature between a high temperature and a low temperature becomes larger, radiation and heat transfer is further promoted. Thus, even in the case of the discontinuous operation of reciprocating a recording sheet to perform recording intermittently, by making heat radiated by the radiation portion 10, the time taken until the temperature of the heat storage sheet 7 rises gradually and reaches a melting temperature can be delayed, and the time for which the heat storage materials 9 melt can also be lengthened. Thus, the heat storage sheet 7 can be suitably used for cooling of the thermal head 2, effectively using radiation of heat by the radiation portion 10. As a result, the heat storage sheet 7 that is subjected to surface processing that improves a radiation rate can be suitably used for the thermal printer 1 that performs continuous operation and discontinuous operation.

In addition, the invention is not limited to the above embodiment, and various changes thereof can be made, if necessary.

EXAMPLES

In a line thermal printer in which recording is performed by a thermal head in which a plurality of heat-generating elements are arranged in a line, and a cooling fan is not disposed, as Example 1, a thermal printer in which a heat storage sheet that is not subjected to surface processing is attached to a thermal conduction plate that supports the thermal head was prepared. Further, as Example 2, a thermal printer in which a heat storage sheet that is subjected to surface processing for improving a radiation rate was prepared, and as a comparative example, a thermal printer in which a heat storage sheet is not attached was prepared. Then, recording operation was continuously performed by each thermal printer, and the temperature in the vicinity of each thermal head was measured by a thermistor disposed in the vicinity of the thermal head.

In Examples 1 and 2, a latent-heat-type heat storage sheet, having a thickness of 1.5 mm, in which a plurality of heat storage materials are added to a base material was used as the heat storage sheet, the melting temperature was set to 45 to 54° C., and the heat storage sheet was attached to a position 10 mm apart from the thermal head. Further, in the respective examples and comparative example, the standby temperature was set to 55° C. at the measurement temperature of the thermistor. Then, each thermal printer was set so as to await that, if the temperature of the thermal head reaches a standby temperature, recording operation is interrupted, and the temperature of the thermal head is cooled to a predetermined temperature.

Figure 4:
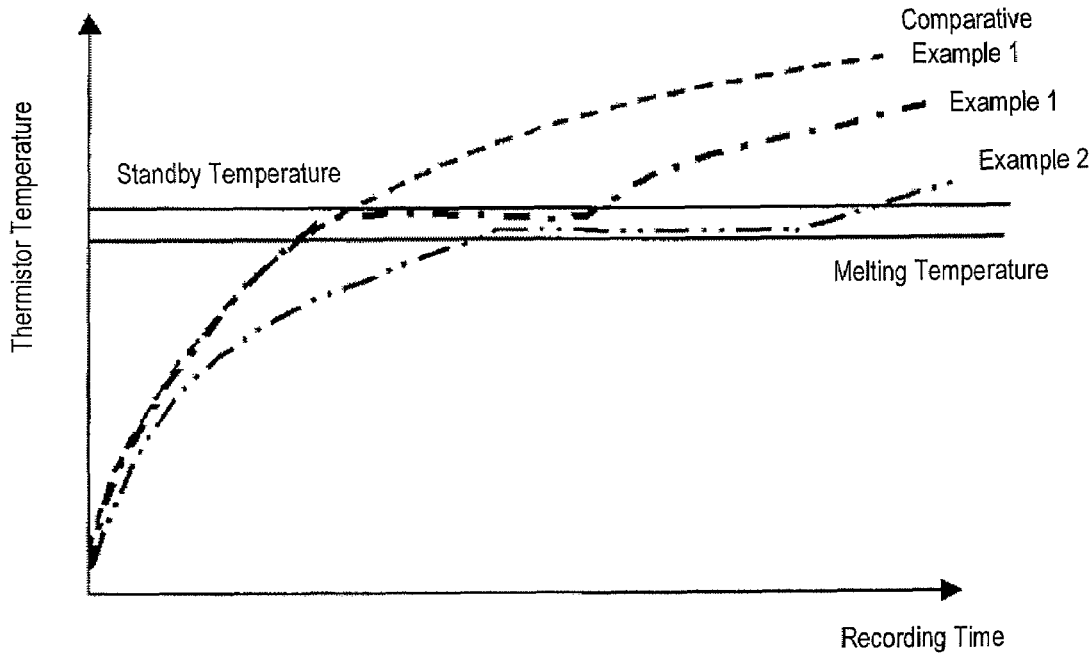
FIG. 4 is a graph showing the relationship between the temperatures in the vicinity of the thermal head that are measured by the thermistor and recording time.

Temperatures in the vicinity of the thermal head that were measured by the thermistor are shown in FIG. 4.

As shown in FIG. 4, according to Comparative Example 1, the temperature in the vicinity of the thermal head exceeded a standby temperature immediately after the start of continuous recording, and the thermal printer was put into a standby state at the time of recording of about a second sheet after the start of recording.

On the other hand, according to Example 1, the temperature in the vicinity of the thermal head sheet after continuous recording was started rose to the melting temperature of the heat storage, was maintained at the melting temperature for a predetermined period, and then rose again and exceeded a standby temperature. Accordingly, the time for which the standby temperature was exceeded could be delayed as compared with Comparative Example 1, and the number of sheets on which continuous recording is performed became five sheets or more.

Further, according to Example 2, the temperature in the vicinity of the thermal head after continuous recording was started gently reached a melting temperature as compared with Example 1, was maintained at the melting temperature for a predetermined period, and then exceeded a standby temperature while it rose gently. Accordingly, the temperature in the vicinity of the thermal head of Example 2 had delayed time until it reached a standby temperature as compared with Example 1. Accordingly, the surface of the heat storage sheet becomes a high temperature while the heat storage materials melt in the heat storage sheet, and a temperature difference from the wall surface of a housing of a thermal printer becomes large. Therefore, this is considered that heat transfer by radiation was promoted and the time required to reach melting time and standby time became delayed. Moreover, in Example 2, even after the thermal head reached standby time, heat could not be efficiently radiated by radiation and heat transfer.

The invention claimed is:

1. A thermal printer comprising:

a thermal head provided with a heat-generating element; and a head supporting portion that supports the thermal head;

wherein a sheet-like heat storage member is attached to the other end of the head supporting portion opposite its one end where the thermal head is supported, and the thermal head is directly secured to the head supporting portion, and a radiation portion is provided on the surface of the heat storage member.

* * * * *